US011200835B2

(12) United States Patent
Yue et al.

(10) Patent No.: US 11,200,835 B2
(45) Date of Patent: Dec. 14, 2021

(54) PIXEL CIRCUIT AND DRIVING METHOD THEREOF, DISPLAY SUBSTRATE, DISPLAY DEVICE

(71) Applicant: BOE TECHNOLOGY GROUP CO., LTD., Beijing (CN)

(72) Inventors: Han Yue, Beijing (CN); Xiaochuan Chen, Beijing (CN); Minghua Xuan, Beijing (CN); Can Zhang, Beijing (CN); Can Wang, Beijing (CN); Ming Yang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 217 days.

(21) Appl. No.: 16/611,387

(22) PCT Filed: May 5, 2019

(86) PCT No.: PCT/CN2019/085540
§ 371 (c)(1),
(2) Date: Nov. 6, 2019

(87) PCT Pub. No.: WO2019/214547
PCT Pub. Date: Nov. 14, 2019

(65) Prior Publication Data

US 2021/0335214 A1 Oct. 28, 2021

(30) Foreign Application Priority Data

May 10, 2018 (CN) ..... 201810445154.X

(51) Int. Cl.
*G09G 3/32* (2016.01)
*G09G 3/20* (2006.01)

(52) U.S. Cl.
CPC ..... *G09G 3/32* (2013.01); *G09G 3/2092* (2013.01); *G09G 2300/0426* (2013.01); *G09G 2320/0233* (2013.01)

(58) Field of Classification Search
CPC ..... G09G 3/32; G09G 3/2092; G09G 2300/0426; G09G 2320/0233
See application file for complete search history.

(56) References Cited

U.S. PATENT DOCUMENTS 9,460,656 B2 10/2016 Shim et al.
2015/0379923 A1* 12/2015 Lee ..... H01L 27/3272 345/206

(Continued)

FOREIGN PATENT DOCUMENTS

CN 104700774 A 6/2015
CN 107871471 A 4/2018

(Continued)

OTHER PUBLICATIONS

International Search Report of PCT/CN2019/085540 in Chinese, dated Jul. 31, 2019, with English translation.

*Primary Examiner* — Andrew Sasinowski
(74) *Attorney, Agent, or Firm* — Collard & Roe, P.C.

(57) ABSTRACT

A pixel circuit and a driving method thereof, a display substrate, and a display device are provided. The pixel circuit includes a driving circuit and a compensation circuit, the compensation circuit can connect the output terminal with the second power terminal to receive a second power signal under control of the voltage signal of the control node and a level of the second driving node.

20 Claims, 7 Drawing Sheets

(56) References Cited

U.S. PATENT DOCUMENTS

| | | | | |
|---|---|---|---|---|
| 2016/0098961 | A1* | 4/2016 | Han | G09G 3/3291 345/691 |
| 2016/0111042 | A1* | 4/2016 | Pyeon | G09G 3/3208 345/212 |
| 2018/0005565 | A1 | 1/2018 | Rotzoll | |
| 2018/0190224 | A1* | 7/2018 | Kim | G09G 3/342 |
| 2019/0180681 | A1 | 6/2019 | Wang | |
| 2019/0237019 | A1* | 8/2019 | Gao | G09G 3/3233 |
| 2020/0402449 | A1* | 12/2020 | Zhang | G09G 3/32 |

FOREIGN PATENT DOCUMENTS

| | | | |
|---|---|---|---|
| CN | 108447441 | A | 8/2018 |
| KR | 10-2017-0080327 | A | 7/2017 |

* cited by examiner providing the gate driving signal having a first potential by the gate line, providing the data signal by the data line, and inputting the first power signal from the first power terminal, by the driving circuit, to the first driving node in response to the gate driving signal and the data signal; and in a case where the light-emitting element operates normally, connecting the first driving node to the second driving node, and turning off the compensation circuit under control of a level of the second driving node; S501

↓ in a case where the light-emitting element operates abnormally, disconnecting the first driving node from the second driving node, inputting a third power signal to the second driving node by the third power terminal, and inputting the second power signal from the second power terminal to the output terminal, by the compensation circuit, under control of the level of the second driving node. S502

FIG. 5

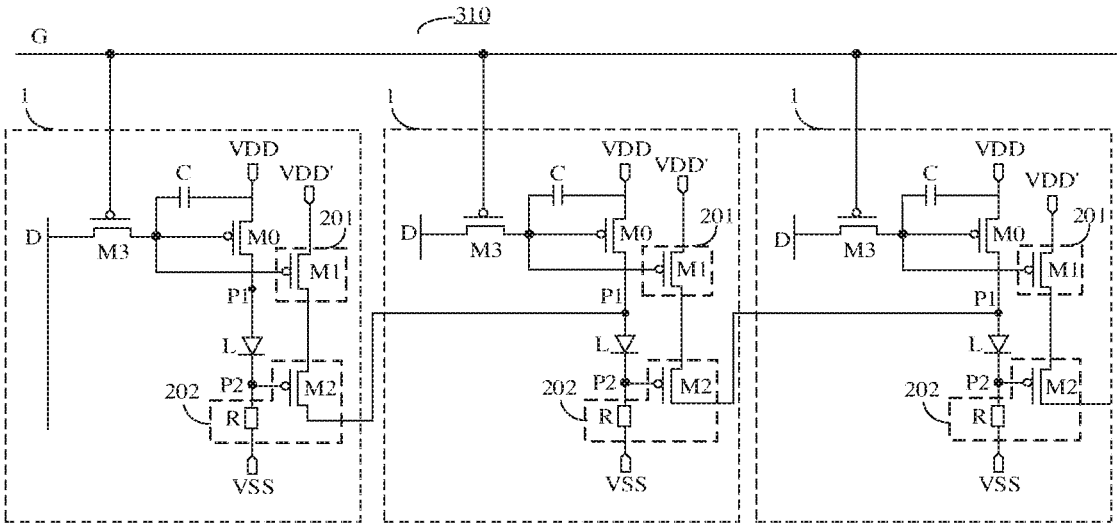

FIG. 6

PIXEL CIRCUIT AND DRIVING METHOD THEREOF, DISPLAY SUBSTRATE, DISPLAY DEVICE

CROSS REFERENCE TO RELATED APPLICATIONS

This application is the National Stage of PCT/CN2019/085540 filed on May 5, 2019, which claims priority under 35 U.S.C. § 119 of Chinese Application No. 201810445154.X filed on May 10, 2018, the disclosure of which is incorporated by reference.

TECHNICAL FIELD

The embodiments of the present disclosure relate to a pixel circuit and a driving method thereof, a display substrate, and a display device.

BACKGROUND

A micro light-emitting diode (MicroLED) is a light-emitting device using an inorganic material as a light-emitting material. A display device using the MicroLED as a light-emitting device has advantages of high brightness, fast response, and high stability.

SUMMARY

At least one embodiment of the present disclosure provides a pixel circuit comprising a driving circuit and a compensation circuit, the driving circuit is respectively connected to a gate line, a data line, a first power terminal, a control node, and a first driving node, the driving circuit is configured to write a data signal of the data line to the control node in response to a gate driving signal of the gate line, and to connect the first driving node with the first power terminal to receive a first power signal under control of a voltage signal of the control node, and the first driving node is connected to one electrode of a light-emitting element; and the compensation circuit is respectively connected to a second power terminal, a third power terminal, the control node, a second driving node, and an output terminal, the compensation circuit is configured to, in response to the voltage signal of the control node and a signal of the second driving node, connect a first driving node of another pixel circuit with the second power terminal to receive a second power signal, and the second driving node is connected to the other electrode of the light-emitting element.

For example, in the pixel circuit provided by at least one embodiment of the present disclosure, the output terminal is connected to the first driving node of another pixel circuit, or, connected to another light-emitting element comprised in the pixel circuit in which the output terminal is located.

For example, in the pixel circuit provided by at least one embodiment of the present disclosure, the compensation circuit comprises a compensation sub-circuit and a switch sub-circuit, the compensation sub-circuit is respectively connected to the second power terminal, the control node, and the switch sub-circuit, and the compensation sub-circuit is configured to input the second power signal to the switch sub-circuit in response to the voltage signal of the control node; and the switch sub-circuit is respectively connected to the third power terminal, the second driving node, and the output terminal, and the switch sub-circuit is configured to connect the compensation sub-circuit to the output terminal under control of a level of the second driving node to input the second power signal to the output terminal.

For example, in the pixel circuit provided by at least one embodiment of the present disclosure, the compensation sub-circuit comprises a first transistor, and a gate electrode of the first transistor is connected to the control node, a first electrode of the first transistor is connected to the second power terminal to receive the second power signal, and a second electrode of the first transistor is connected to the switch sub-circuit.

For example, in the pixel circuit provided by at least one embodiment of the present disclosure, the switch sub-circuit comprises a second transistor, and a gate electrode of the second transistor is connected to the second driving node, a first electrode of the second transistor is connected to the second electrode of the first transistor, and a second electrode of the second transistor is connected to the output terminal.

For example, in the pixel circuit provided by at least one embodiment of the present disclosure, the switch sub-circuit further comprises a resistor, and one terminal of the resistor is connected to the second driving node, the other terminal of the resistor is connected to the third power terminal to receive a third power signal.

For example, in the pixel circuit provided by at least one embodiment of the present disclosure, the driving circuit comprises a driving sub-circuit, a data writing sub-circuit, and a storage sub-circuit, the driving sub-circuit comprises a control terminal, a first terminal, and a second terminal, and is configured to control a driving current for driving the light-emitting element to emit light in response to the voltage signal of the control node, and the first terminal of the driving sub-circuit is configured to receive the first power signal from the first power terminal; the data writing sub-circuit is connected to the storage sub-circuit, the gate line, the data line, and the control node, and is configured to write the data signal of the data line to the control node and the storage sub-circuit in response to the gate driving signal of the gate line; and the storage sub-circuit is connected to the control node and the first power terminal, and is configured to store the data signal written by the data writing sub-circuit.

For example, in the pixel circuit provided by at least one embodiment of the present disclosure, the data writing sub-circuit comprises a switch transistor, and a gate electrode of the switch transistor is connected to the gate line to receive the gate driving signal, a first electrode of the switch transistor is connected to the data line to receive the data signal, and a second electrode of the switch transistor is connected to the control node.

For example, in the pixel circuit provided by at least one embodiment of the present disclosure, the driving sub-circuit comprises a driving transistor, and a gate electrode of the driving transistor is connected to the control node, a first electrode of the driving transistor is connected to the first power terminal to receive the first power signal, and a second electrode of the driving transistor is connected to the first driving node.

For example, in the pixel circuit provided by at least one embodiment of the present disclosure, the storage sub-circuit comprises a capacitor, and one terminal of the capacitor is connected to the first power terminal to receive the first power signal, and the other terminal of the capacitor is connected to the control node.

For example, in the pixel circuit provided by at least one embodiment of the present disclosure, the first power terminal and the second power terminal are a same power terminal or different power terminals.

At least one embodiment of the present disclosure also provides a driving method of a pixel circuit, the driving method is used for driving the pixel circuit according to any one of the embodiments of the present disclosure, the driving method comprises: providing the gate driving signal having a first potential by the gate line, providing the data signal by the data line, and inputting the first power signal from the first power terminal, by the driving circuit, to the first driving node in response to the gate driving signal and the data signal; in a case where the light-emitting element operates normally, connecting the first driving node to the second driving node, and turning off the compensation circuit under control of a level of the second driving node; and in a case where the light-emitting element operates abnormally, disconnecting the first driving node from the second driving node, inputting a third power signal to the second driving node by the third power terminal, and inputting the second power signal from the second power terminal to the output terminal, by the compensation circuit, under control of the level of the second driving node.

For example, in the driving method of the pixel circuit provided by at least one embodiment of the present disclosure, a potential of the first power signal and a potential of the second power signal are both a second potential, and a potential of the third power signal is the first potential.

For example, in the driving method of the pixel circuit provided by at least one embodiment of the present disclosure, the compensation circuit comprises a compensation sub-circuit and a switch sub-circuit, and in the case where the light-emitting element operates abnormally, the compensation sub-circuit is turned on in response to the voltage signal of the control node, and the switch sub-circuit is turned on under control of the level of the second driving node, so that the output terminal is connected to the second power terminal to receive the second power signal of the second power terminal.

For example, in the driving method of the pixel circuit provided by at least one embodiment of the present disclosure, the driving circuit comprises a driving sub-circuit, a data writing sub-circuit, and a storage sub-circuit, the driving method also comprises a data writing phase and a light-emitting phase, in the data writing phase, the gate driving signal and the data signal are input to turn on the data writing sub-circuit, and the data writing sub-circuit writes the data signal to the control node and the storage sub-circuit; and in the light-emitting phase, the driving sub-circuit is turned on under control of the voltage signal of the control node to apply a driving current to the first driving node.

At least one embodiment of the present disclosure also provides a display substrate comprising a plurality of pixel units arranged in an array, each of the plurality of pixel units comprises the pixel circuit according to any one of the embodiments of the present disclosure and a light-emitting element, and an output terminal of a current pixel circuit is connected to a first driving node of another pixel circuit or to another light-emitting element of the current pixel circuit.

For example, in the display substrate provided by at least one embodiment of the present disclosure, the another pixel circuit connected to the output terminal of the current pixel circuit is located in a same row or in a same column as the current pixel circuit; a distance between the another pixel circuit connected to the output terminal of the current pixel circuit and the current pixel circuit is shortest, and a color of a pixel unit, to which the another pixel circuit belongs, and a color of a pixel unit, to which the current pixel circuit belongs, are identical.

For example, in the display substrate provided by at least one embodiment of the present disclosure, the light-emitting element is a micro light-emitting diode.

At least one embodiment of the present disclosure also provides a display device, comprising the display substrate according to any one of the embodiments of the present disclosure.

BRIEF DESCRIPTION OF THE DRAWINGS

In order to clearly illustrate the technical solutions of the embodiments of the disclosure, the drawings of the embodiments will be briefly described in the following; it is obvious that the described drawings are only related to some embodiments of the disclosure and thus are not limitative to the disclosure.

FIG. 5 is a flowchart of a driving method of a pixel circuit according to at least one embodiment of the present disclosure;

FIG. 6 is a schematic block diagram of a display substrate according to at east one embodiment of the present disclosure;

DETAILED DESCRIPTION

Figure 1A:
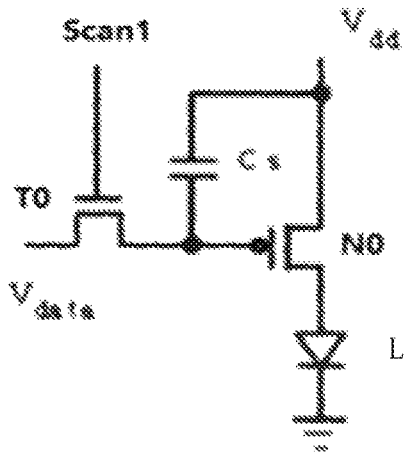
FIG. 1A is a schematic diagram of a 2T1C pixel circuit.

In order to make objects, technical details, and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

The embodiments of the present disclosure are described in detail below, and the examples of the embodiments are illustrated in the drawings, from first to last, the same or similar reference numerals indicate the same or similar elements or elements having the same or similar functions. The embodiments described below with reference to the accompanying drawings are illustrative, are intended to illustrate the present disclosure, and are not to be construed as limiting the embodiments of the present disclosure.

Figure 1B:
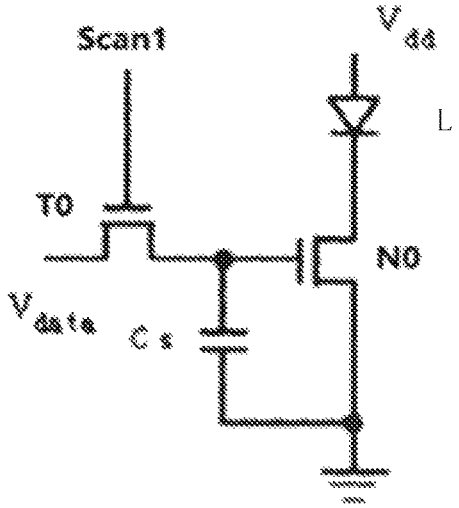
FIG. 1B is a schematic diagram of another 2T1C pixel circuit.

In a case of manufacturing a MicroLED display device, thin film transistors arranged in an array are generally formed on a circuit substrate (for example, a switch transistor T0 and a driving transistor NO as shown in FIG. 1A or FIG. 1B), that is, a backplane is manufactured; and then a plurality of MicroLEDs arranged in an array are formed on another substrate, for example, a material of the substrate may be an inorganic material such as monocrystalline silicon, gallium arsenide, or the like; and finally, the plurality of MicroLEDs formed on the substrate are batch-transferred onto the circuit substrate on which the thin film transistors are formed. So that a pixel circuit structure shown, for example, in FIG. 1A or FIG. 1B can be formed.

However, in a process of batch-transferring the MicroLEDs by the related technology, because the number of the MicroLEDs is large and a size of each MicroLED is small, some MicroLEDs may fail to be transferred, thereby affecting the display effect of the display device and reducing the display quality of the display device. For example, the size of the MicroLED (for example, a long side of a rectangle or an edge length of a square) is less than 100 microns, for example, is less than 50 microns.

FIG. 1A and FIG. 1B are schematic diagrams showing two 2T1C pixel circuits, respectively.

As shown in FIG. 1A, a 2T1C pixel circuit comprises a switch transistor T0, a driving transistor NO, and a storage capacitor Cs. For example, a gate electrode of the switch transistor T0 is connected to a scan line to receive a gate driving signal Scant, for example, a source electrode of the switch transistor T0 is connected to a data line to receive a data signal Vdata, and a drain electrode of the switch transistor T0 is connected to a gate electrode of the driving transistor NO; a source electrode of the driving transistor NO is connected to a first voltage terminal to receive a first voltage Vdd (high voltage), a drain electrode of the driving transistor NO is connected to a positive terminal of a MicroLED; one terminal of the storage capacitor Cs is connected to the drain electrode of the switch transistor T0 and the gate electrode of the driving transistor NO, the other terminal of the storage capacitor Cs is connected to the first voltage terminal to receive the first voltage Vdd; a negative terminal of the MicroLED is connected to a second voltage terminal to receive a second voltage Vss (low voltage, such as a grounded voltage). A driving method of the 2T1C pixel circuit is to control the brightness and darkness (gray scale) of a pixel by two TFTs and a storage capacitor Cs. In a case where the gate driving signal Scant is applied through the scan line to turn on the switch transistor T0, the data signal Vdata input by a data driving circuit through the data line charges the storage capacitor Cs via the switch transistor T0, and therefore, the data signal Vdata is stored in the storage capacitor Cs, and the data signal Vdata, which is stored, controls a conduction degree of the driving transistor NO, thereby controlling a value of a current flowing through the driving transistor and driving the MicroLED to emit light, that is, the current determines a gray scale of light emitted by the pixel. In the 2T1C pixel circuit as shown in FIG. 1A, the switch transistor T0 is an N-type transistor and the driving transistor NO is a P-type transistor.

As shown in FIG. 1B, another 2T1C pixel circuit also comprises a switch transistor T0, a driving transistor NO, and a storage capacitor Cs, but the connection mode of the 2T1C pixel circuit as shown in FIG. 1B is slightly changed, and the driving transistor NO is an N-type transistor. The change of the 2T1C pixel circuit as shown in FIG. 1B with respect to the 2T1C pixel circuit as shown in FIG. 1A comprises that: a positive terminal of a MicroLED is connected to a first voltage terminal to receive a first voltage Vdd (high voltage), a negative terminal of the MicroLED is connected to a drain electrode of the driving transistor NO, and a source electrode of the driving transistor NO is connected to a second voltage terminal to receive a second voltage Vss (low voltage, such as grounded voltage). One terminal of the storage capacitor Cs is connected to a drain electrode of the switch transistor T0 and a gate electrode of the driving transistor N0, the other terminal of the storage capacitor Cs is connected to a source electrode of the driving transistor N0 and the second voltage terminal. An operation mode of the 2T1C pixel circuit is basically the same as that of the pixel circuit as shown in FIG. 1A, and details are not described herein again.

For example, on the basis of the example as shown in FIG. 1A, a compensation circuit (for example, the compensation circuit can be implemented as a compensation transistor not shown in the figure) can also be included to compensate for a threshold voltage of the driving transistor N0 or the voltage drop of a power supply line (for example, providing the first voltage Vdd). For example, the compensation circuit comprises a first terminal, a second terminal, and a control terminal, and the first terminal, the second terminal, and the control terminal are respectively connected to the gate electrode of the driving transistor N0, the drain electrode of the driving transistor N0, and a compensation signal line (not shown in the figure, for example, the compensation signal line may be a scan line). For example, in a compensation phase, the compensation circuit is turned on in response to a compensation signal provided by the compensation signal line, so as to electrically connect the gate electrode and the drain electrode of the driving transistor N0, and therefore, the related information about the threshold voltage of the driving transistor N0 can be correspondingly stored in the storage capacitor Cs, so that the threshold voltage of the driving transistor N0 can be compensated, and thus, in a light-emitting phase, a driving current flowing through the MicroLED is only related to the data signal and the like, and is no longer related to the threshold voltage of the driving transistor N0, and therefore, the compensation for the pixel circuit can be achieved, the problem of the drift of the threshold voltage of the driving transistor N0 caused by the technology process, long-time operation, and the like is solved, and the display unevenness caused by the influence of the threshold voltage on the driving current is eliminated. Moreover, in some examples, the driving current flowing through the MicroLED is no longer related to the first voltage Vdd, thereby solving the problem of the display unevenness of the display panel caused by the deviation of the first voltage Vdd caused by the voltage drop of the power supply line. For example, an operation mode of a compensation circuit not shown in FIG. 1B is similar to that of the compensation circuit not shown in FIG. 1A, and details are not described herein again.

In addition, for the pixel circuits as shown in FIG. 1A and FIG. 1B, the switch transistor T0 is not limited to be an N-type transistor, and may also be a P-type transistor as needed, provided that the polarity of the gate driving signal Scan 1 that is used to control the switch transistor T0 to be turned on or oft may be changed accordingly.

For example, in a case where the transfer-printing of the MicroLED in the pixel circuit as shown in FIG. 1A or FIG. 1B malfunctions, the pixel circuit as shown in FIG. 1A or FIG. 1B does not have a MicroLED, thereby affecting the display effect of the display device and reducing the display quality of the display device.

At least one embodiment of the present disclosure provides a pixel circuit comprising a driving circuit and a compensation circuit. The driving circuit is respectively connected to a gate line, a data line, a first power terminal, a control node, and a first driving node, the driving circuit is configured to write a data signal of the data line to the control node in response to a gate driving signal of the gate line, and to connect the first driving node with the first power terminal to receive a first power signal under control of a voltage signal of the control node, and the first driving node is connected to one electrode of a light-emitting element; and the compensation circuit is respectively connected to a second power terminal, a third power terminal, the control node, a second driving node, and an output terminal, the compensation circuit is configured to, in response to the voltage signal of the control node and a signal of the second driving node, connect the output terminal with the second power terminal to receive a second power signal, and the second driving node is connected to the other electrode of the light-emitting element.

At least one embodiment of the present disclosure also provides a driving method corresponding to the above pixel circuit, a display substrate, and a display device.

The pixel circuit provided by the above embodiments of the present disclosure can input a second power signal to the output terminal in a case where the light-emitting element connected to the pixel circuit malfunctions and cannot normally emit light, so that the light-emitting brightness of a light-emitting element connected to another pixel circuit can be enhanced or a substitute light-emitting element can be driven to emit light, thereby ensuring the display effect of the display device and improving the display quality of the display device.

In order to make the object, technical solutions, and advantages of the embodiments of the present disclosure more apparent, the embodiments of the present disclosure will be further described in detail below.

The transistors used in all embodiments of the present disclosure may be thin film transistors or field effect transistors or other devices having the same characteristics. Depending on the function of the transistors in the circuit, the transistors adopted in the embodiments of the present disclosure are mainly switch transistors. Because a source electrode and a drain electrode of a switch transistor used herein may be symmetrical in structure, the source electrode and the drain electrode are interchangeable. In the embodiments of the present disclosure, the source electrode is referred to as a first electrode and the drain electrode is referred to as a second electrode. According to the configuration in the drawing, a middle terminal of the transistor is defined as a gate electrode, a signal input terminal is the source electrode, and a signal output terminal is the drain electrode. In addition, the switch transistor used in the embodiment of the present disclosure may be any one of a P-type transistor and an N-type transistor, a P-type switch transistor is turned on in a case where a level of the gate electrode of the P-type switch transistor is a low level, and is turned off in a case where the level of the gate electrode of the P-type switch transistor is a high level, an N-type switch transistor is turned on in a case where a level of the gate electrode of the N-type switch transistor is a high level, and is turned off in a case where the level of the gate electrode of the N-type switch transistor is a low level. Moreover, each of a plurality of signals in the various embodiments of the present disclosure corresponds to a first potential and a second potential, and the first potential and the second potential only represent that a potential of a signal has two different state quantities, and do not represent that the first potential or the second potential in the specification has a specific value. For example, in some embodiments of the present disclosure, a level of the first potential is a low level and a level of the second potential is a high level. It should be noted that the level of the first potential and the level of the second potential are set according to actual conditions, and the embodiments of the present disclosure are not limited thereto.

Figure 2A:
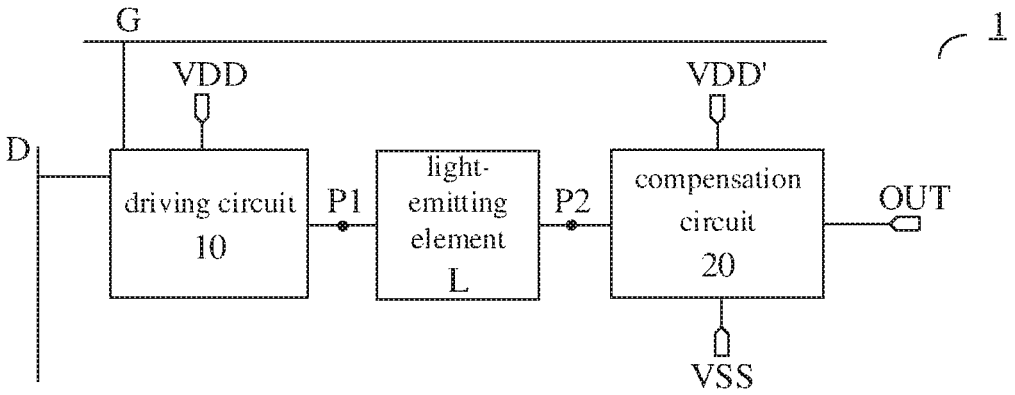
FIG. 2A is a schematic block diagram of a pixel circuit according to at least one embodiment of the present disclosure.

FIG. 2A is a schematic block diagram of a pixel circuit according to at least one embodiment of the present disclosure. A pixel circuit 1 is used to, for example, drive a light-emitting element in a sub-pixel of a display panel to emit light. In at least one embodiment of the present disclosure, the display panel is manufactured, for example, by a glass substrate, a specific structure and a manufacture process of the display panel may adopt a method in the art, are not described in detail herein, and the embodiments of the present disclosure are not limited thereto. For example, the light-emitting element may be a MicroLED, may also be an OLED (organic light emitting diode) or QLED (Quantum Dot Light Emitting Diode), or the like, and a corresponding display panel is a MicroLED display panel, or an OLED display panel or a QLED display panel, or the like. The embodiments of the present disclosure will be described below by taking a light-emitting element as a MicroLED as an example, and the embodiments of the present disclosure are not limited thereto.

As shown in FIG. 2A, the pixel circuit 1 may comprise: a driving circuit 10 and a compensation circuit 20, the driving circuit 10 may comprise a driving transistor (not shown in FIG. 2A).

Referring to FIG. 2A, the driving circuit 10 may be respectively connected to a gate line G, a data line D, a first power terminal VDD, a control node N, and a first driving node P1. The driving circuit 10 is configured to write a data signal of the data line D to the control node N in response to a gate driving signal of the gate line G, and to connect the first driving node P1 with the first power terminal VDD to receive a first power signal under control of a voltage signal of the control node N. For example, the first driving node P1 is connected to one electrode of a light-emitting element L. For example, the first driving node P1 may be connected to an anode of the light-emitting element L.

Figure 2B:
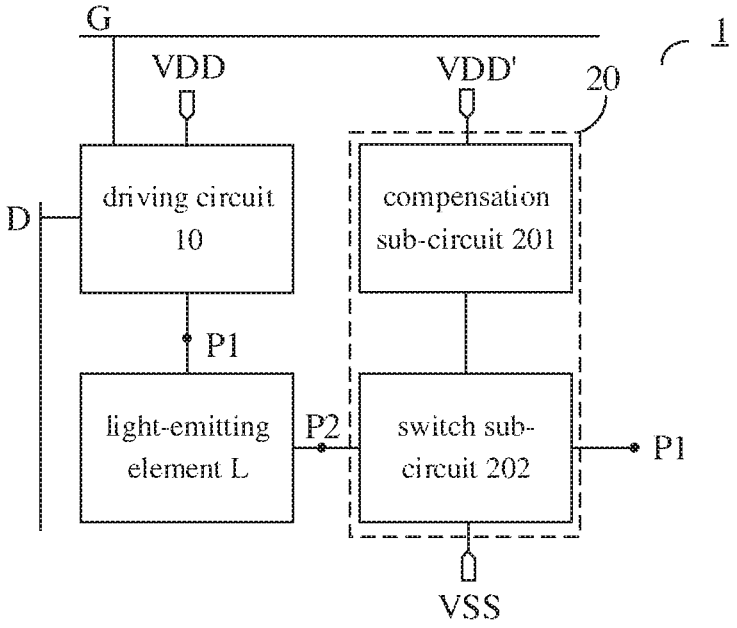
FIG. 2B is a schematic block diagram of another pixel circuit according to at least one embodiment of the present disclosure.
Figure 2C:
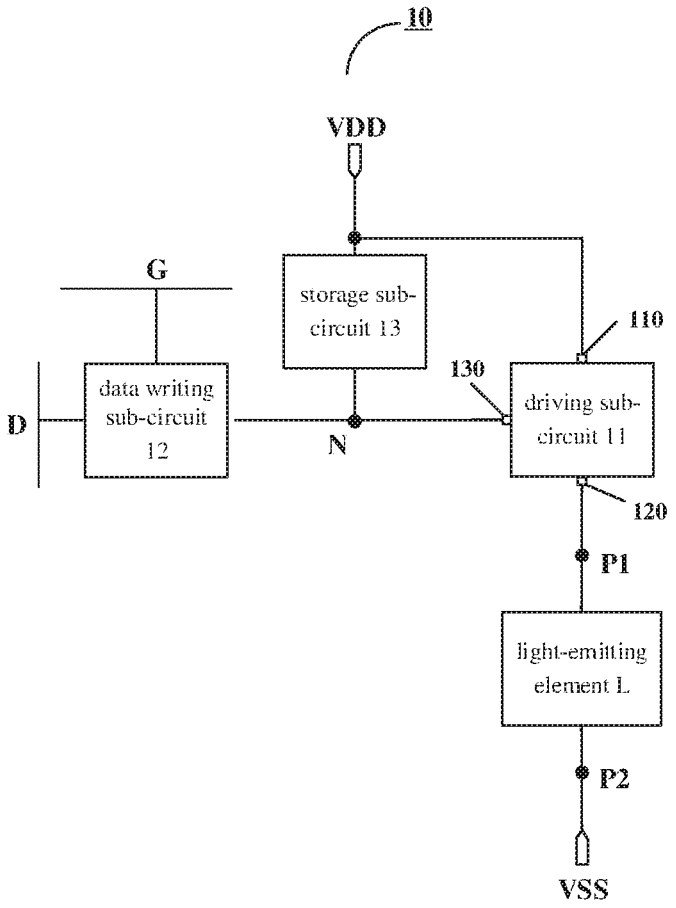
FIG. 2C is a schematic block diagram of a driving circuit as shown in FIG. 2A or FIG. 2B.

FIG. 2C is a schematic block diagram of the driving circuit as shown in FIG. 2A. For example, in the example as shown in FIG. 2C, the driving circuit 10 may comprise a driving sub-circuit 11, a data writing sub-circuit 12, and a storage sub-circuit 13. The driving sub-circuit 11 is used, for example, to control a driving current that drives the light-emitting element L to emit light.

Figure 3:
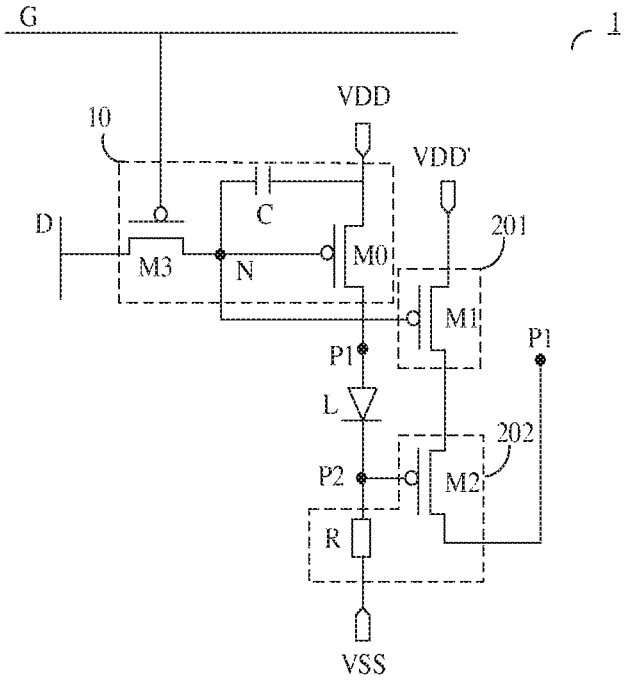
FIG. 3 is a circuit schematic diagram of a specific implementation example of the pixel circuit as shown in FIG. 2B.

For example, the driving sub-circuit 11 comprises a control terminal 130 (for example, a gate electrode of the driving transistor N0 shown in FIG. 3), a first terminal 110 (for example, a first electrode of the driving transistor N0 shown in FIG. 3), and a second terminal 120 (for example, a second electrode of the driving transistor N0 shown in FIG. 3), and is configured to control a driving current for driving the light-emitting element L to emit light in response to the voltage signal of the control node N, and the first terminal 110 of the driving sub-circuit 11 is configured to receive the first power signal from the first power terminal VDD.

The data writing sub-circuit 12 is connected to the storage sub-circuit 1.3, the gate line G, the data line D, and the control node N, and is configured to write the data signal of the data line D to the control node N and the storage sub-circuit 13 in response to the gate driving signal of the gate line G. For example, in a data writing phase, the data writing sub-circuit 12 can be turned on in response to the gate driving signal, so that the data signal can be written to the control terminal 130 of the driving sub-circuit 11 (that is, the control node N and the storage sub-circuit 13), and then the data signal can be stored in the storage sub-circuit 13, the data signal, which is stored, can be used to control a conduction degree of the driving sub-circuit 11, thereby controlling to generate the driving current that drives the light-emitting element to emit light.

The storage sub-circuit 13 is connected to the control node N and the first power terminal VDD, and is configured to store the data signal written by the data writing sub-circuit 12.

For example, in a case where a potential of the gate driving signal provided by the gate line G is the first potential, and a potential of the data signal provided by the data line D is the first potential, the data writing sub-circuit 12 is turned on to write the data signal to the control node N and the storage sub-circuit 13. The driving sub-circuit 11 is turned on under control of the control node N, and may input the first power signal from the first power terminal VDD to the first driving node P1, and a potential of the first power signal may be a second potential, and the second potential may be an inactive potential. For example, the second potential is higher than the first potential.

Referring to FIG. 2A, the compensation circuit 20 may be respectively connected to a second power terminal VDD', a third power terminal VSS, the control node N (for example, the gate electrode of the driving transistor (not shown in FIG. 2A)), a second driving node P2, and an output terminal OUT, and the compensation circuit 20 is configured to, in response to the voltage signal of the control node N and a signal of the second driving node P2, connect the output terminal OUT and the second power terminal VDD' to receive a second power signal. For example, the second driving node P2 is connected to the other electrode of the light-emitting element L. For example, the second driving node P2 may connected to a cathode of the light-emitting element L.

For example, the output terminal OUT can be connected to a first driving node (not shown in the figure) in another pixel circuit or another light-emitting element (not shown in the figure) in a current pixel circuit. For example, another light-emitting element (not shown in the figure) belongs to the current pixel circuit and is connected to the compensation circuit 20. For example, another light-emitting element serves as a substitute light-emitting element, and in a case where the light-emitting element L malfunctions or malfunctions to be transferred, another light-emitting element can emit light instead of the light-emitting element L. It should be noted that, hereinafter, the embodiments will be described by taking a case that the output terminal OUT is connected to the first driving node in another pixel circuit as an example, and the circuit connection and the driving method are also applicable to the case where the output terminal OUT is connected to another light-emitting element in the current pixel circuit, and the embodiments of the present disclosure do not describe about this case again.

Figure 4:
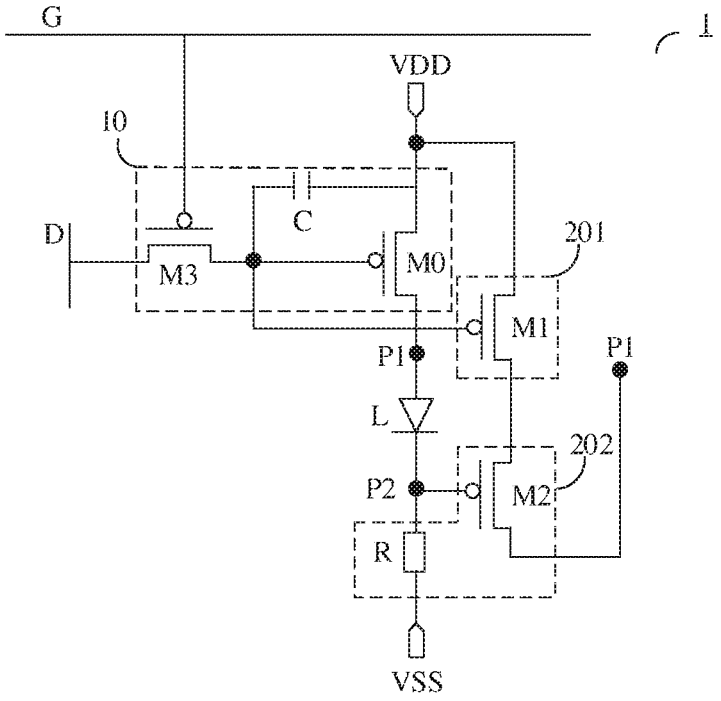
FIG. 4 is a circuit schematic diagram of another specific implementation example of the pixel circuit as shown in FIG. 2B.

For example, the first power terminal VDD and the second power terminal VDD' may be different power terminals, or may be the same power terminal (as shown in FIG. 4), which is not limited by the embodiments of the present disclosure.

In the embodiments of the present disclosure, the light-emitting element Lin the pixel circuit 1 may be a MicroLED light-emitting element, or may also be a light-emitting element such as a LED or an OLED, and the embodiments of the present disclosure are not limited thereto.

For example, assuming that the light-emitting element L malfunctions (for example, the MicroLED is lost during the transferring process or the connection of the MicroLED after being transferred is poor), so as to cause that the first driving node P1 of the pixel circuit 1 is disconnected from the second driving ode P2 of the pixel circuit 1. In a case where the pixel circuit 1 is in the light-emitting phase, a potential of a signal of the gate electrode of the driving transistor is the first potential, and the driving transistor is turned on, and the first power signal is input to the first driving node P1. Because the first driving node P1 is disconnected from the second driving node P2, thus in this case, the third power terminal VSS can input a third power signal to the second driving node P2. The compensation circuit 20 is turned on under control of the third power signal, and can input the second power signal to the first driving node P1 of another pixel circuit, so that in a case where the light-emitting element L to which the pixel circuit 1 is connected cannot normally emit light, the second power signal can be input to the first driving node P1 of another pixel circuit, thereby enhancing the light-emitting brightness of the light-emitting element L connected to another pixel circuit to compensate for the light-emitting brightness of the light-emitting element L which has malfunctions, and ensuring the display effect of the display device; or in a case where the light-emitting element L to which the pixel circuit 1 is connected cannot normally emit light, the second power signal can be input to another light-emitting element in the current pixel circuit connected to the output terminal OUT, so that another light-emitting element can replace the light-emitting element that cannot normally emit light to emit light, thereby improving the display quality of the display device.

In summary, the pixel circuit provided by the embodiments of the present disclosure comprises a compensation circuit, and the compensation circuit can be turned on under control of the voltage signal of the control node N and the level of the second driving node, and can input the second power signal from the second power terminal VDD' to the first driving node P1 in another pixel circuit, so that in a case where the light-emitting element L to which the pixel circuit 1 is connected malfunctions and cannot emit light normally, the second power signal can be input to the first driving node P1 of another pixel circuit, thereby enhancing the light-emitting brightness of the light-emitting element connected to another pixel circuit, ensuring the display effect of the display device, and improving the display quality of the display device.

For example, in order to further ensure the display effect of the display device, the another pixel circuit connected to the compensation circuit of the pixel circuit may be located in a same row or in a same column as the pixel circuit, and a distance between the another pixel circuit connected to the compensation circuit of the pixel circuit and the pixel circuit may be shortest, and a color of a pixel unit to which the another pixel circuit belongs and a color of a pixel unit to which the pixel circuit belongs are the same.

FIG. 2B is a schematic block diagram of another pixel circuit according to at least one embodiment of the present disclosure. As shown in FIG. 2B, the compensation circuit 20 may comprises a compensation sub-circuit 201 and a switch sub-circuit 202.

Referring to FIG. 2B, the compensation sub-circuit 201 may be respectively connected to the second power terminal VDD', the control node N (the gate electrode of the driving transistor (not shown in FIG. 2B)), and the switch sub-circuit 202, and the compensation sub-circuit 201 can input the second power signal to the switch sub-circuit 202 in response to the voltage signal of the control node N.

For example, in a case where the pixel circuit is in the light-emitting phase, the potential of the signal of the gate electrode of the driving transistor is the first potential, the compensation sub-circuit 201 is turned on in response to the first potential such that the switch sub-circuit 202 is connected to the second power terminal VDD' to input the second power signal to the switch sub-circuit 202. For example, the potential of the second power signal can be the second potential.

Referring to FIG. 2B, the switch sub-circuit 202 may be respectively connected to the third power terminal VSS, the second driving node P2, and a first driving node P1 of another pixel circuit (that is, the output terminal OUT), and the switch sub-circuit 202 is configured to connect the compensation sub-circuit 201 to the first driving node P1 of another pixel circuit in response to the signal of the second driving node P2 to input the second power signal to the first driving node P1 of another pixel circuit.

For example, assuming that the light-emitting element L malfunctions, so as to cause that the first driving node Pt of the pixel circuit 1 is disconnected from the second driving node P2 of the pixel circuit 1, the third power terminal VSS can input a third power signal to the second driving node P2, the switch sub-circuit 202 is turned on in response to the signal of the second driving node P2, so as to connect the compensation sub-circuit 201 to the first driving node P1 of another pixel circuit, thereby inputting the second power signal to the first driving node P1 of another pixel circuit. For example, the potential of the third power signal may be the first potential, and the first potential may be an active potential.

It should be noted that, in the description of various embodiments of the present disclosure, the first driving node P1, the second driving node P2, and the control node N do not represent actual elements, but represent the conjunction points at which the relevant circuit are connected in the circuit diagram, and are for convenience of description.

FIG. 3 is a circuit schematic diagram of a specific implementation example of the pixel circuit as shown in FIG. 2B. As shown in FIG. 3, the pixel circuit 1 comprises a driving transistor M0 and first to third transistors M1, M2, M3, and comprises a capacitor C, a resistor R, and a light-emitting element L (such as, MicroLED). For example, the first to third transistors M1, M2, M3 are used as switch transistors. For example, the light-emitting element can be of various types, such as can be a top emission light-emitting element, a bottom emission light-emitting element, etc., and can emit red light, green light, blue light, or white light, etc., and the embodiments of the present disclosure do not limit this case. For example, in the embodiments of the present disclosure, each switch transistor can be a P-type transistor, and the driving transistor M0 may be a P-type transistor. For example, the P-type transistor is turned on in response to a low-level signal, and is turned off in response to a high-level signal. The following embodiments are the same as those described herein, and the similar description will not be described again.

As shown in FIG. 3, the compensation sub-circuit 201 may comprise a first transistor M1. Referring to FIG. 3, a gate electrode of the first transistor M1 may be connected to a gate electrode of the driving transistor M0 (that is, the control node N), a first electrode of the first transistor M1 may be connected to the second power terminal VDD' to receive the second power signal, and a second electrode of the first transistor M1 may be connected to a first electrode of the second transistor M2.

For example, as shown in FIG. 3, the switch sub-circuit 202 may comprise a second transistor M2.

A gate electrode of the second transistor M2 may be connected to the second driving node P2, a second electrode of the second transistor M2 may be connected to the first driving node P1 of another pixel circuit (that is, the output terminal OUT shown in FIG. 2A).

The switch sub-circuit 202 may also comprise a resistor R. One terminal of the resistor R is connected to the second driving node P2, the other terminal of the resistor R is connected to the third power terminal VSS to receive the third power signal.

In the embodiments of the present disclosure, the resistor R can perform voltage dividing on the third power signal provided by the third power terminal VSS, that is, a voltage on the second driving node P2 is smaller than the voltage of the third power signal, so that in a case where the light-emitting element L to which the pixel circuit 1 is connected can normally emit light, the first driving node P1 can input the first power signal to the second driving node P2 through the light-emitting element L, the second transistor M2 can be kept turned off under control of the second driving node P2, thereby avoiding the compensation circuit 20 in the pixel circuit 1 from inputting the second power signal to the first driving node P1 of another pixel circuit in a case where the light-emitting element L normally emit light, avoiding causing the problem that the light-emitting brightness of the light-emitting elements to which the different pixel circuits are connected in the display device are different, and further ensuring the display effect of the display device.

For example, as shown in FIG. 3, the driving circuit 10 may comprise a switch transistor M3, a driving transistor M0, and a capacitor C.

Referring to FIG. 2C and FIG. 3, the data writing sub-circuit 12 comprises the switch transistor M3. A gate electrode of the switch transistor M3 may be connected to the gate line G to receive the gate driving signal, a first electrode of the switch transistor M3 may be connected to the data line D to receive the data signal, and a second electrode of the switch transistor M3 may be connected to the control node N (that is, the gate electrode of the driving transistor M0).

For example, the driving sub-circuit 11 comprises the driving transistor M0. A first electrode of the driving transistor M0 may be connected to the first power terminal VDD to receive the first power signal, and a second electrode of the driving transistor M0 may be connected to the first driving node P1.

The storage sub-circuit 13 comprises a capacitor C. One terminal of the capacitor C may be connected to the first power terminal VDD (that is, the first electrode of the driving transistor M0) to receive the first power signal, and the other terminal of the capacitor C is connected to the control node N (that is, the gate electrode of the driving transistor M0).

It should be noted that, the above driving circuit 10 having a 2T1C structure is merely an example, and of course, the driving circuit may also be any other circuit that can drive the light-emitting element to emit light, such as 4T2C, 5T1C, 7T1C, etc., and the embodiments of the present disclosure are not limited thereto.

In at least one embodiment of the present disclosure, as shown in FIG. 4, the first power terminal VDD and the second power terminal VDD' may be the same power terminal VDD. By setting the first power terminal VDD and the second power terminal VDD' to be the same power terminal VDD, the wiring space occupied by the pixel circuit can be reduced, and the wiring cost can be reduced. Moreover, because the gate electrode of the first transistor M1 is connected to the gate electrode of the driving transistor M0, in a case where the switch transistor M3 is turned on, the data line D can simultaneously provide the data signal to the gate electrode of the driving transistor M0 and the gate electrode of the first transistor M1. The first power terminal VDD and the second power terminal VDD' are set to be the same power terminal VDD, so that the voltage applied to the first electrode of the driving transistor M0 can be equal to the voltage applied to the first electrode of the first transistor M1, and therefore, in a case where the light-emitting element L, to which the pixel circuit is connected, cannot normally emit light, under driving of the data signal provided by the data line D, a value of a compensation current provided by the first transistor M1 for the light-emitting element, to which another pixel circuit is connected, is equal to a value of the driving current output by the driving transistor M0, in this case, the light-emitting brightness of the light-emitting element, to which another pixel circuit is connected, can accurately compensate the light-emitting brightness loss caused by a reason that the light-emitting element, to which the current pixel circuit is connected, cannot normally emit light, thereby achieving the accurate compensation for the display brightness of the display device, and more effectively ensuring the display effect of the display device.

It should be noted that, in the embodiments of the present disclosure, the driving circuit may also be other structure including a larger number of transistors in addition to the structure of 2T1C (that is, two transistors and one capacitor) as shown in FIG. 3 or FIG. 4, and the embodiments of the present disclosure are not limited thereto.

It should be also noted that, the above embodiments are described by taking a case that the first transistor, the second transistor, the switch transistor, and the driving transistor are all P-type transistors, and the first potential is a low potential with respect to the second potential, as an example. Certainly, the first transistor, the second transistor, the switch transistor, and the driving transistor may also adopt N-type transistors, in a case where the first transistor, the second transistor, the switch transistor, and the driving transistor are all N-type transistors, the first potential is a high potential with respect to the second potential, and the embodiments of the present disclosure are not limited thereto.

In summary, the pixel circuit provided by the embodiment of the present disclosure comprises a compensation circuit, the compensation circuit can input the second power signal from the second power terminal to the first driving node in another pixel circuit under control of the voltage signal of the control node and the level of the second driving node, so that in a case where the light-emitting element, to which the pixel circuit is connected, malfunctions and cannot normally emit light, the second power signal can be input to the first driving node of another pixel circuit, thereby enhancing the light-emitting brightness of the light-emitting element connected to another pixel circuit, ensuring the display effect of the display device, and improving the display quality of the display device.

FIG. 5 is a flowchart of a driving method of a pixel circuit according to at least one embodiment of the present disclosure, as shown in FIG. 5, the driving method can used to drive the pixel circuit as described in any one of FIG. 2A to FIG. 4, and the driving method may comprise:

S501: providing the gate driving signal having a first potential by the gate line, providing the data signal by the data line, and inputting the first power signal from the first power terminal, by the driving circuit, to the first driving node in response to the gate driving signal and the data signal; in a case where the light-emitting element operates normally, connecting the first driving node to the second driving node, and turning off the compensation circuit under control of the second driving node.

In the embodiments of the present disclosure, in a case where the light-emitting element L, to which the pixel circuit 1 is connected, emits light normally, that is, in a case where the light-emitting element L does not occur malfunction, the first driving node P1 and the second driving node P2 may be connected through the light-emitting element L. In this case, the first driving node P1 can input the first power signal to the second driving node P2 through the light-emitting element L, and the compensation circuit 20 can be turned off under control of the second driving node P2, thereby ensuring the display effect of the light-emitting element L, to which the pixel circuit 1 is connected, in a case where the light-emitting element L operates normally.

S502: in a case where the light-emitting element operates abnormally, disconnecting the first driving node from the second driving node, inputting a third power signal to the second driving node by the third power terminal, and inputting the second power signal from the second power terminal to the output terminal, by the compensation circuit, under control of the level of the second driving node.

For example, a potential of the first power signal and a potential of the second power signal may both be second potentials, and a potential of the third power signal may be a first potential.

Figure 7:
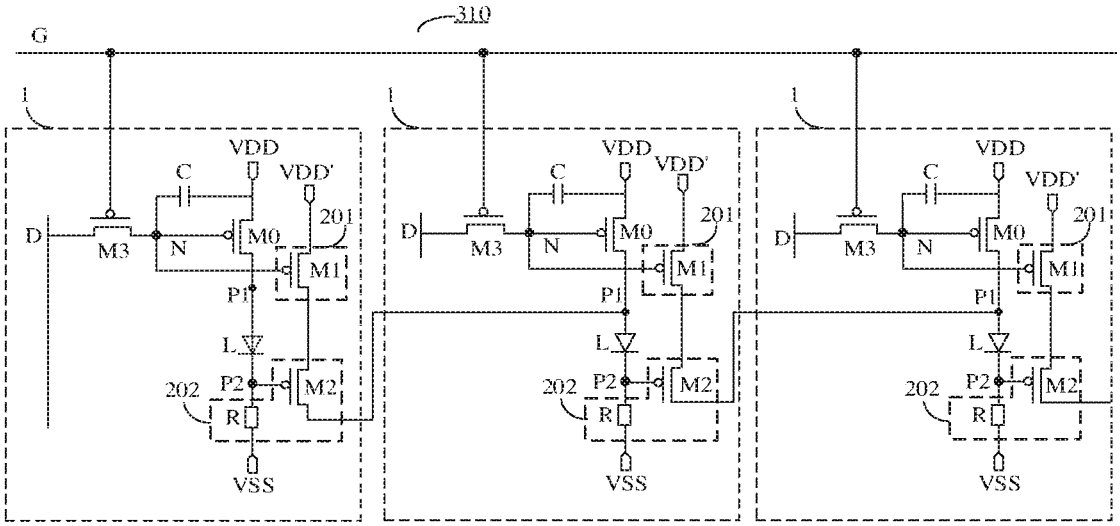
FIG. 7 is a schematic block diagram of another display substrate according to at least one embodiment of the present disclosure.

In the embodiments of the present disclosure, in a case where the light-emitting element L operates abnormally, that is, the first driving node P1 and the second driving node P2 of the pixel circuit 1 are disconnected (the first power terminal VDD and the third power terminal VSS are disconnected) due to the failure of the light-emitting element L (as shown in FIG. 7), the first driving node P1 cannot input the first power signal to the second driving node P2 through the light-emitting element L, and the third power terminal VSS can input the third power signal to the second driving node P2, the compensation circuit 20 can input the second power signal form the second power terminal VDD' to the first driving node P1 (that is, the output terminal) in another pixel circuit under control of the level of the second driving node P2.

For example, in a case where the compensation circuit 20 comprises the compensation sub-circuit 201 and the switch sub-circuit 202, in the case where the light-emitting element L operates abnormally, the compensation sub-circuit 201 is turned on in response to the voltage signal of the control node N, and the switch sub-circuit 202 is turned on under control of a level of the second driving node P2, so that the first driving node P1 in another pixel circuit is connected to the second power terminal VSS to receive the second power signal of the second power terminal VDD'.

For example, the driving circuit 10 comprises a driving sub-circuit 11, a data writing sub-circuit 12, and a storage sub-circuit 13, the driving method also comprises a data writing phase and a light-emitting phase.

In the data writing phase, the gate driving signal and the data signal are input to turn on the data writing sub-circuit 12, and the data writing sub-circuit 12 writes the data signal to the control node N and the storage sub-circuit 13.

In the light-emitting phase, the driving sub-circuit 11 is turned on under control of the voltage signal of the control node N to apply a driving current to the first driving node P1.

In summary, in the driving method of the pixel circuit provided by the embodiment of the present disclosure, the driving circuit 10 may input the first power signal to the first driving node P1 in response to the gate driving signal and the data signal. In a case where the light-emitting element operates abnormally, the third power terminal VSS can input the third power signal to the second driving node, and the compensation circuit may input the second power signal to the first driving node P1 in another pixel circuit under control of the level of the second driving node P2 and the data signal, so that in a case where the light-emitting element, to which the pixel circuit is connected, malfunctions and cannot normally emit light, the second power signal can be input to the first driving node P1 of another pixel circuit, thereby enhancing the light-emitting brightness of the light-emitting element L connected to another pixel circuit, ensuring the display effect of the display device, and improving the display quality of the display device.

In the embodiments of the present disclosure, taking the pixel circuit 1 as shown in FIG. 3 as an example, and taking each transistor in the pixel circuit 1 being a P-type transistor as an example, the driving principle of the pixel circuit provided by the embodiment of the present disclosure is described in detail.

In the embodiments of the present disclosure, referring to FIG. 3, in a case where the gate line G provides the gate driving signal having the first potential, the switch transistor M3 is turned on, the data line D input the data signal to the gate electrode of the driving transistor M0 through the switch transistor M3, and the driving transistor M0 and the first transistor M1 are turned on. The driving transistor M0 can input the first power signal from the first power terminal VDD to the first driving node P1 under control of the data signal. Moreover, the data signal can determine the value of the driving current output by the driving transistor M0, that is, the data signal can determine the light-emitting brightness (i.e., gray scale) of the light-emitting element L to which the pixel circuit is connected. The first transistor M1 can input the second power signal from the second power terminal VDD' to the second transistor M2 under control of the data signal. Therefore, the data signal can control the light-emitting brightness of the light-emitting element L in another pixel circuit through the first transistor M1 and the second transistor M2.

For example, as shown in FIG. 3, in a case where the light-emitting element L, to which the pixel circuit 1 is connected, operates normally, the first driving node P1 is connected to the second driving node P2. In this case, the pixel circuit 1 can input the first power signal of the first driving node P1 to the second driving node P2 through the light-emitting element L, and the second transistor M2 can be turned off under control of the second driving node P2; and in a case where the light-emitting element L, to which the pixel circuit 1 is connected, cannot operate normally due to the failure, the first driving node P1 is disconnected from the second driving node P2, that is, the first power terminal VDD and the third power terminal VSS are disconnected, the third power terminal VSS can input the third power signal to the second driving node P2, and the second transistor M2 can be turned on under control of the second driving node P2. In this case, the second power terminal VDD' can input the second power signal to the first driving node P1 of another pixel circuit through the second transistor M2, thereby enhancing the light-emitting brightness of the light-emitting element connected to another pixel circuit, so as to compensate for the light-emitting brightness of the light-emitting element which malfunctions, and ensuring the display effect of the display device.

It should be also noted that, the above embodiments are described by taking a case that the first transistor, the second transistor, the switch transistor, and the driving transistor are all P-type transistors, and the first potential is a low potential with respect to the second potential, as an example. Certainly, the first transistor, the second transistor, the switch transistor, and the driving transistor may also adopt N-type transistors, in a case where the first transistor, the second transistor, the switch transistor, and the driving transistor are all N-type transistors, the first potential is a high potential with respect to the second potential.

In summary, in the driving method of the pixel circuit provided by the embodiment of the present disclosure, the driving circuit 10 may input the first power signal to the first driving node P1 in response to the gate driving signal and the data signal. In a case where the light-emitting element L operates abnormally, the third power terminal VSS can input the third power signal to the second driving node, and the compensation circuit 20 may input the second power signal to the first driving node P1 in another pixel circuit under control of the level of the second driving node P2 and the data signal, so that in a case where the light-emitting element L, to which the pixel circuit is connected, malfunctions and cannot normally emit light, the second power signal can be input to the first driving node P1 of another pixel circuit, thereby enhancing the light-emitting brightness of the light-emitting element L connected to another pixel circuit, ensuring the display effect of the display device, and improving the display quality of the display device.

FIG. 6 is a schematic block diagram of a display substrate according to at least one embodiment of the present disclosure; and FIG. 7 is a schematic block diagram of another display substrate according to at least one embodiment of the present disclosure. A display substrate 310 may comprise a plurality of pixel units arranged in an array, each of the plurality of pixel units may comprise the pixel circuit as shown in FIG. 3 or FIG. 4. For example, FIG. 6 shows three pixel units. Referring to FIG. 6, the compensation circuit 20 of the pixel circuit 1 in each pixel unit may be connected to the first driving node P1 of another pixel circuit 1.

For example, another pixel circuit 1, to which the compensation circuit 20 of each pixel circuit 1 is connected, may be located in the same row or in the same column as the pixel circuit 1. In addition, another pixel circuit 1, to which the compensation circuit 20 of each pixel circuit 1 is connected, may be closest to the pixel circuit 1, and a color of a pixel unit, to which another pixel circuit 1 belongs, and a color of a pixel unit, to which the pixel circuit 1 belongs, are identical.

In the embodiments of the present disclosure, in order to better enhance the display effect of the display device, another pixel circuit 1, to which the compensation circuit 20 of each pixel circuit 1 is connected, may be located in the same row as the pixel circuit 1. In addition, another pixel circuit 1, to which the compensation circuit 20 of each pixel circuit 1 is connected, may be closest to the pixel circuit 1, and a color of a pixel unit, to which another pixel circuit 1 belongs, and a color of a pixel unit, to which the pixel circuit 1 belongs, are identical.

For example, each pixel unit may refer to one sub-pixel (also referred to as a secondary pixel), and the plurality of pixels can be arranged in an array on the display substrate, each pixel may comprise a plurality of pixel units of different colors. For example, each pixel may comprise a red pixel unit, a green pixel unit, and a blue pixel unit. In the embodiments of the present disclosure, a compensation circuit of a pixel circuit in a current red pixel unit may be connected to a first driving node of a pixel circuit in a red pixel unit that is located in the same row as the current red pixel unit and is closest to the current red pixel unit; a compensation circuit of a pixel circuit in a current green pixel unit may be connected to a first driving node of a pixel circuit in a green pixel unit that is located in the same row as the current green pixel unit and is closest to the current green pixel unit; and a compensation circuit of a pixel circuit in a current blue pixel unit may be connected to a first driving node of a pixel circuit in a blue pixel unit that is located in the same row as the current blue pixel unit and is closest to the current blue pixel unit.

Therefore, in a case where the light-emitting element L do not operate normally (for example, as shown in FIG. 7, a light-emitting element L in a first pixel circuit 1 is missing (for example, the light-emitting element L indicated by a dotted line in FIG. 7 does not exist)), the third power terminal VSS can input the third power signal to the second driving node, and the compensation circuit 20 may input the second power signal to the first driving node P1 in another pixel circuit under control of the level of the second driving node P2 and the data signal, so that in a case where the light-emitting element L, to which the pixel circuit is connected, malfunctions and cannot normally emit light, the second power signal can be input to the first driving node P1 of another pixel circuit, thereby enhancing the light-emitting brightness of the light-emitting element L connected to another pixel circuit, ensuring the display effect of the display device, and improving the display quality of the display device.

Figure 8:
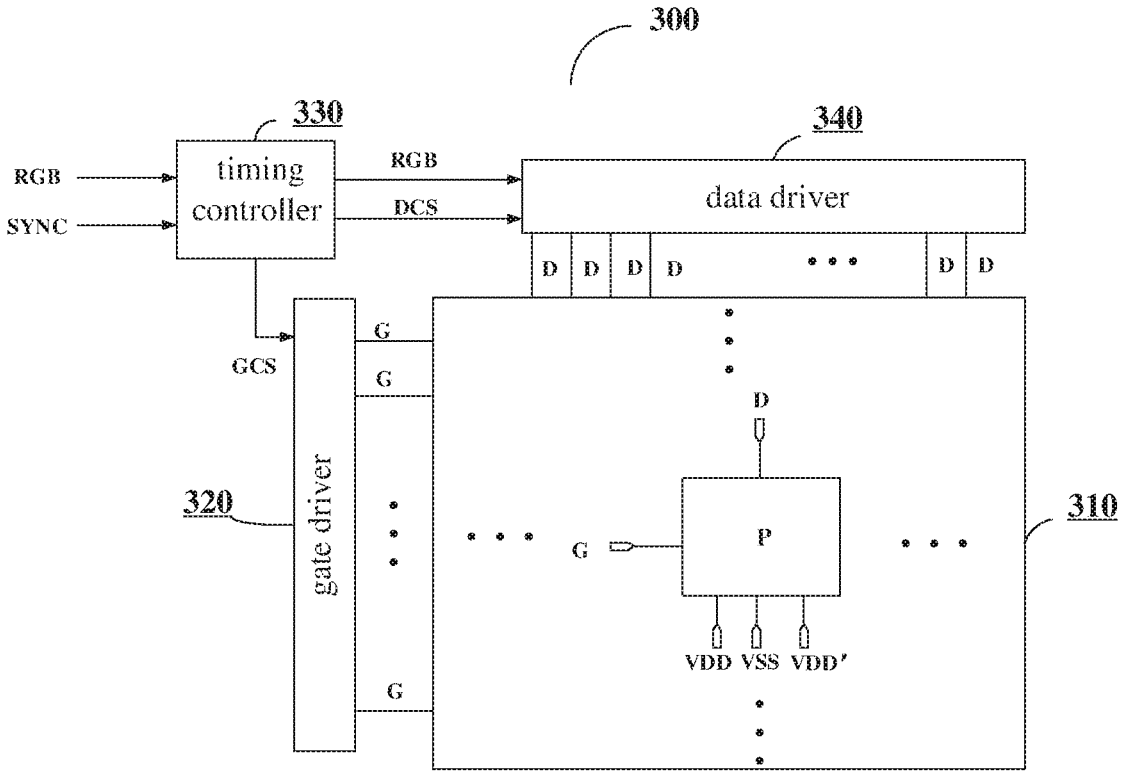
FIG. 8 is a schematic block diagram of a display device according to at least one embodiment of the present disclosure.

At least one embodiment of the present disclosure also provides a display device, the display device may comprise the display substrate 310 as shown in FIG. 6. As shown in FIG. 8, the display device 300 comprises a plurality of pixel units P, each pixel unit P comprises any one of the pixel circuits 1 provided by the above embodiments and a light-emitting element L. For example, each pixel unit P comprises the pixel circuit 1 as shown in FIG. 3 or FIG. 4. For example, the connection mode of the pixel circuit 1 is as shown in FIG. 6. As shown in FIG. 8, the display device 300 also comprises a plurality of gate lines G and a plurality of data lines D. It should be noted that, only a part of the pixel units P, a part of the gate lines G, and a part of the data lines D are shown in FIG. 8.

For example, in some examples, the plurality of pixel units P are arranged in a plurality of rows, control terminals of the data writing sub-circuits 12 (as shown in FIG. 2C) of the pixel circuits 1 of the pixel units in one row are connected to the same gate line G, so that the same gate line G provides a gate driving signal to the data writing sub-circuits 12. For example, the data line of each column is connected to input terminals of the data writing sub-circuits 12 of the pixel circuits 10 in the column to provide a data signal.

For example, the driving sub-circuit 11 (as shown in FIG. 2C) comprises a control terminal 130, a first terminal 110, and a second terminal 120, and the first terminal 110 of the driving sub-circuit 11 is connected to the first power terminal VDD to receive the first power signal, and the compensation circuit 20 (as shown in FIG. 2A or FIG. 2B) is connected to the second power terminal VDD' and the third power terminal VSS to receive the second power signal and the third power signal, respectively.

It should be noted that, the display device 300 as shown in FIG. 8 may also comprise a plurality of first voltage lines, a plurality of second voltage lines, and a plurality of third voltage lines which are used to provide a first voltage, a second voltage, and a third voltage, respectively.

For example, as shown in FIG. 8, the display device 300 may also comprise a display panel 310, a gate driver 320, a data driver 340, and a timing controller 330. The display panel 310 comprises a plurality of pixel units P defined according to a plurality of gate lines G and a plurality of data lines D; the gate diver 320 is configured to drive the plurality of gate lines G, the data driver 340 is configured to drive the plurality of data lines D, the timing controller 330 is configured to process image data KGB input from the outside of the display device 300, provide the processed image data. RGB to the data driver 340, and output a scan control signal GCS and a data control signal DCS to the gate driver 320 and the data driver 340, so as to control the gate driver 320 and the data driver 340.

As shown in FIG. 8, the display panel 310 comprises the plurality of gate lines G and the plurality of data lines D which are intersected with the plurality of gate lines G. A pixel unit P is disposed at an intersection area of a gate line G and a data line D. For example, each pixel unit P is connected to a gate line G (used to provide a gate driving signal), a data line D, a first voltage line for providing a first power signal, a second voltage line for providing a second power signal, and a third voltage line for providing a third power signal. Moreover, the first voltage line, the second voltage line, or the third voltage line herein may be replaced with a corresponding plate-like common electrode (for example, a common anode or a common cathode).

For example, the gate driver 320 provides a plurality of gate signals to the plurality of gate lines G according to a plurality of scan control signals GCS derived from the timing controller 330. The plurality of gate signals comprises a gate driving signal. These gate signals are provided to respective pixel units P through the plurality of gate lines G.

For example, the data driver 340 converts the digital image data RGB input from the timing controller 330 into data signals according to a plurality of data control signals DCS derived from the timing controller 330 by using reference gamma voltages. The data driver 340 provides the converted data signals to the plurality of data lines D.

For example, the timing controller 330 sets the image data RGB input from the outside to match the size and resolution of the display panel 310, and then supplies the set image data to the data driver 340. The timing controller 330 generates the plurality of scan control signals GCS and the plurality of data control signals DCS by using synchronization signals (for example, a dot clock DCLK, a data enable signal DE, a horizontal synchronization signal Hsync, and a vertical synchronization signal Vsync) input from the outside of the display device. The timing controller 330 respectively provides the generated scan control signals GCS and data control signals DCS to the gate driver 320 and the data driver 340 for controlling the gate driver 320 and the data driver 340.

For example, the data driver 340 may be connected to the plurality of data lines D to provide the data signals Vdata; and may also connected to the plurality of first voltage lines, the plurality of second voltage lines, and the plurality of third voltage lines to provide the first power signal, the second power signal, and the third power signal, respectively.

For example, the gate driver 320 may be implemented as a semiconductor chip, and the data driver 340 may be implemented as a semiconductor chip. The display device 300 may also include other elements, such as signal decoding circuits, voltage conversion circuits, etc., these elements may be, for example, conventional elements, and may not be described in detail herein again.

The display device 300 may be: a MicroLED display substrate, a liquid crystal panel, an electronic paper, an OLED panel, an AMOLED panel, a mobile phone, a tablet, a television, a monitor, a notebook computer, a digital photo frame, a navigator, or any products or elements having a display function.

Those skilled in the art can clearly understand that: for the convenience and brevity of the description, the specific working processes of the pixel circuit 1 and the display device 300 can refer to the corresponding processes in the foregoing embodiments of the method, and detail are not described herein again.

What have been described above are only specific implementations of the present disclosure, the protection scope of the present disclosure is not limited thereto. The protection scope of the present disclosure should be based on the protection scope of the claims.

What is claimed is:

1. A pixel circuit, comprising: a driving circuit and a compensation circuit, wherein the driving circuit is respectively connected to a gate line, a data line, a first power terminal, a control node, and a first driving node, the driving circuit is configured to write a data signal of the data line to the control node in response to a gate driving signal of the gate line, and to connect the first driving node with the first power terminal to receive a first power signal under control of a voltage signal of the control node, and the first driving node is connected to one electrode of a light-emitting element; and the compensation circuit is respectively connected to a second power terminal, a third power terminal, the control node, a second driving node, and an output terminal, the compensation circuit is configured to, in response to the voltage signal of the control node and a signal of the second driving node, connect a first driving node of another pixel circuit with the second power terminal to receive a second power signal, and the second driving node is connected to the other electrode of the light-emitting element.

2. The pixel circuit according to claim 1, wherein the output terminal is connected to the first driving node of another pixel circuit, or, connected to another light-emitting element comprised in the pixel circuit in which the output terminal is located.

3. The pixel circuit according to claim 2, wherein the compensation circuit comprises a compensation sub-circuit and a switch sub-circuit, the compensation sub-circuit is respectively connected to the second power terminal, the control node, and the switch sub-circuit, and the compensation sub-circuit is configured to input the second power signal to the switch sub-circuit in response to the voltage signal of the control node; and the switch sub-circuit is respectively connected to the third power terminal, the second driving node, and the output terminal, and the switch sub-circuit is configured to connect the compensation sub-circuit to the output terminal, under control of a level of the second driving node, to input the second power signal to the output terminal.

4. The pixel circuit according to claim 3, wherein the compensation sub-circuit comprises a first transistor, and a gate electrode of the first transistor is connected to the control node, a first electrode of the first transistor is connected to the second power terminal to receive the second power signal, and a second electrode of the first transistor is connected to the switch sub-circuit.

5. The pixel circuit according to claim 4, wherein the switch sub-circuit comprises a second transistor, and a gate electrode of the second transistor is connected to the second driving node, a first electrode of the second transistor is connected to the second electrode of the first transistor, and a second electrode of the second transistor is connected to the output terminal.

6. The pixel circuit according to claim 4, wherein the switch sub-circuit further comprises a resistor; and one terminal of the resistor is connected to the second driving node, the other terminal of the resistor is connected to the third power terminal to receive a third power signal.

7. The pixel circuit according to claim 1, wherein the driving circuit comprises a driving sub-circuit, a data writing sub-circuit, and a storage sub-circuit, the driving sub-circuit comprises a control terminal, a first terminal, and a second terminal, and is configured to control a driving current for driving the light-emitting element to emit light in response to the voltage signal of the control node, and the first terminal of the driving sub-circuit is configured to receive the first power signal from the first power terminal;

the data writing sub-circuit is connected to the storage sub-circuit, the gate line, the data line, and the control node, and is configured to write the data signal of the data line to the control node and the storage sub-circuit in response to the gate driving signal of the gate line; and the storage sub-circuit is connected to the control node and the first power terminal, and is configured to store the data signal written by the data writing sub-circuit.

8. The pixel circuit according to claim 7, wherein the data writing sub-circuit comprises a switch transistor, and a gate electrode of the switch transistor is connected to the gate line to receive the gate driving signal, a first electrode of the switch transistor is connected to the data line to receive the data signal, and a second electrode of the switch transistor is connected to the control node.

9. The pixel circuit according to claim 7, wherein the driving sub-circuit comprises a driving transistor, and a gate electrode of the driving transistor is connected to the control node, a first electrode of the driving transistor is connected to the first power terminal to receive the first power signal, and a second electrode of the driving transistor is connected to the first driving node.

10. The pixel circuit according to claim 7, wherein the storage sub-circuit comprises a capacitor, and one terminal of the capacitor is connected to the first power terminal to receive the first power signal, and the other terminal of the capacitor is connected to the control node.

11. The pixel circuit according to claim 1, wherein the first power terminal and the second power terminal are a same power terminal or different power terminals.

12. A driving method of a pixel circuit, used for driving the pixel circuit according to claim 1, wherein the driving method comprises:

providing the gate driving signal having a first potential by the gate line, providing the data signal by the data line, and inputting the first power signal from the first power terminal, by the driving circuit, to the first driving node in response to the gate driving signal and the data signal;

in a case where the light-emitting element operates normally, connecting the first driving node to the second driving node, and turning off the compensation circuit under control of a level of the second driving node; and in a case where the light-emitting element operates abnormally, disconnecting the first driving node from the second driving node, inputting a third power signal to the second driving node by the third power terminal, and inputting the second power signal from the second power terminal to the output terminal, by the compensation circuit, under control of the level of the second driving node.

13. The driving method of the pixel circuit according to claim 12, wherein a potential of the first power signal and a potential of the second power signal are both a second potential, and a potential of the third power signal is the first potential.

14. The driving method of the pixel circuit according to claim 12, wherein the compensation circuit comprises a compensation sub-circuit and a switch sub-circuit, and in the case where the light-emitting element operates abnormally, the compensation sub-circuit is turned on in response to the voltage signal of the control node, and the switch sub-circuit is turned on under control of the level of the second driving node, so that the output terminal is connected to the second power terminal to receive the second power signal of the second power terminal.

15. The driving method of the pixel circuit according to claim 12, wherein the driving circuit comprises a driving sub-circuit, a data writing sub-circuit, and a storage sub-circuit, the driving method further comprises a data writing phase and a light-emitting phase, in the data writing phase, the gate driving signal and the data signal are input to turn on the data writing sub-circuit, and the data writing sub-circuit writes the data signal to the control node and the storage sub-circuit; and in the light-emitting phase, the driving sub-circuit is turned on under control of the voltage signal of the control node to apply a driving current to the first driving node.

16. A display substrate, comprising a plurality of pixel units arranged in an array, wherein each of the plurality of pixel units comprises the pixel circuit according to claim 1 and a light-emitting element, and an output terminal of a first pixel circuit is connected to a first driving node of second pixel circuit or to another light-emitting element of the first pixel circuit.

17. The display substrate according to claim 16, wherein the second pixel circuit connected to the output terminal of the first pixel circuit is located in a same row or in a same column as the first pixel circuit;

a distance between the second pixel circuit connected to the output terminal of the first pixel circuit and the first pixel circuit is shortest, and a color of a pixel unit, to which the second pixel circuit belongs, and a color of a pixel unit, to which the first pixel circuit belongs, are identical.

18. The display substrate according to claim 16, wherein the light-emitting element is a micro light-emitting diode.

19. A display device, comprising the display substrate according to claim 16.

20. The pixel circuit according to claim 5, wherein the switch sub-circuit further comprises a resistor; and one terminal of the resistor is connected to the second driving node, the other terminal of the resistor is connected to the third power terminal to receive a third power signal.

* * * * *